US007650770B2

(12) United States Patent
Maxwell

(10) Patent No.: US 7,650,770 B2
(45) Date of Patent: Jan. 26, 2010

(54) KEY RING TOOL

(76) Inventor: David Maxwell, 51 Lexington Dr., Pennington, NJ (US) 08534

( * ) Notice: Subject to any disclaimer, the term of this patent is extended or adjusted under 35 U.S.C. 154(b) by 23 days.

(21) Appl. No.: 11/779,542

(22) Filed: Jul. 18, 2007

(65) Prior Publication Data

US 2008/0022738 A1 Jan. 31, 2008

Related U.S. Application Data

(60) Provisional application No. 60/820,261, filed on Jul. 25, 2006.

(51) Int. Cl.
*E05B 19/04* (2006.01)

(52) U.S. Cl. ..... 70/408; 70/456 R; 70/458; D3/207

(58) Field of Classification Search ..... 70/408, 70/456 R–459; 7/151; 81/3.09, 3.55; D3/207, D3/208, 210
See application file for complete search history.

(56) References Cited

U.S. PATENT DOCUMENTS

| | | | | | |
|---|---|---|---|---|---|
| 180,255 | A | | 7/1876 | Miller | |
| 603,247 | A | * | 5/1898 | Becker | 70/458 |
| 629,213 | A | * | 7/1899 | Sheets | 70/459 |
| 739,094 | A | * | 9/1903 | Lewis | 70/458 |
| 765,754 | A | * | 7/1904 | Siersdorfer | 70/456 R |
| 1,462,205 | A | * | 7/1923 | Korns | 70/458 |
| 2,451,091 | A | * | 10/1948 | Whitaker | 70/456 R |
| 3,315,504 | A | * | 4/1967 | Billings, Jr. | 70/408 |
| D262,417 | S | * | 12/1981 | Kim | D3/207 |
| 4,312,128 | A | | 1/1982 | Olsen | |
| 4,325,278 | A | | 4/1982 | Beerens | |
| 4,543,860 | A | | 10/1985 | Van Meter | |
| 4,706,477 | A | | 11/1987 | Rousseau | |
| 4,719,778 | A | | 1/1988 | Murphy et al. | |
| 4,790,161 | A | | 12/1988 | Dick | |
| D311,980 | S | | 11/1990 | Baker | |
| 5,077,850 | A | * | 1/1992 | Brubaker | 7/151 |

(Continued)

FOREIGN PATENT DOCUMENTS

| | | |
|---|---|---|
| DE | 304491 | 7/1917 |

(Continued)

*Primary Examiner*—Suzanne D. Barrett
(74) *Attorney, Agent, or Firm*—Dennis M. Carleton; Richard C. Woodbridge; Fox Rothschild LLP

(57) ABSTRACT

A tool is used to split the coils of a key ring so that the key ring can be easily and efficiently placed on a key or other object. In one embodiment the invention includes a pair of guides, such as ribs or slots, incorporated into the bridge of the key ring grip. One rib or slot assists in getting the key ring onto the key and the other rib or slot assists in removing the key ring from the key. Alternatively, the tool could be separate from the key ring bridge and take the form of a plate having a pair of cut-out sections on opposite sides thereof. One cut-out has a sharp leading edge on the top of the plate and the other has a sharp leading edge on the bottom of the plate. A semicircular handle is attached to one side of the plate and assists it further by widening the gap between the coils so that a key can be threaded onto the free end of the key ring.

7 Claims, 11 Drawing Sheets

U.S. PATENT DOCUMENTS

| | | | | | |
|---|---|---|---|---|---|
| 5,373,717 | A | | 12/1994 | Gore et al. | |
| D357,051 | S | | 4/1995 | Strenkowski | |
| D358,536 | S | * | 5/1995 | Gore et al. | D8/16 |
| D367,343 | S | | 2/1996 | Wise | |
| D374,344 | S | * | 10/1996 | Sunderland et al. | D3/211 |
| D389,628 | S | | 1/1998 | Naft | |
| 5,713,232 | A | | 2/1998 | Hodge | |
| 5,722,277 | A | * | 3/1998 | Williams | 70/456 R |
| D404,621 | S | * | 1/1999 | Liese | D8/16 |
| 6,092,405 | A | | 7/2000 | Berwick | |
| D485,505 | S | | 1/2004 | Cohen | |
| 6,681,608 | B1 | | 1/2004 | Hope, III | |
| 6,860,130 | B2 | | 3/2005 | Brantschem | |
| 7,093,468 | B2 | | 8/2006 | Song | |
| 2008/0264126 | A1 | * | 10/2008 | Huen | 70/456 R |

FOREIGN PATENT DOCUMENTS

| | | |
|---|---|---|
| GB | 2175532 A | 3/1986 |

* cited by examiner

A
B
38
42
64
22
60
44
62
24

KEY RING TOOL

CROSS REFERENCE TO RELATED APPLICATIONS

This application claims the benefit of U.S. Provisional Patent Application Ser. No. 60/820,261 filed Jul. 25, 2006, entitled "Key Ring Tool" by David Maxwell, the entire substance and contents of which are hereby incorporated in total by reference.

BACKGROUND OF THE INVENTION

1. Field of the Invention

The invention relates to a tool to assist placing objects, such as a key, on a key ring.

2. Description of Related Art

There are a number of devices in the prior art employed to assist putting a key, or other item, onto a key ring. They generally fall into two classes. The first class comprises devices that are separate from the key and the second class comprises devices which are incorporated into the key itself.

The following devices appear to be relevant to the first class of tools, namely, those in which the tool is separate from the key ring itself. U.S. Pat. No. 6,860,130 describes an "Easy-To-Maneuver Key-Ring" which is held in place on the key ring and incorporates a tool for spreading the key ring spring. The following patents all appear to describe tools which can be attached to a ring, or separated therefrom and are usable to open the spring of a key ring so that a key can be placed therein: U.S. Pat. Nos. 4,312,128; 4,325,278; 4,543,860; 4,706,477; 4,790,161; 5,373,717; 6,681,608; and, UK Patent Application GB 2 175 532 A. Of lesser relevance are the disclosures in U.S. Pat. Nos. 180,255; 5,713,232; and, Design Patent 311,980.

The following devices appear to be relevant to the second class of inventions, namely, those in which the key ring spreader is incorporated into the key itself. U.S. Pat. No. 6,092,405 describes a key having a head including two wedge shaped portions which can cam a key ring open and then once it is engaged on the key ring reopen it so that it can be disengaged. U.S. Pat. No. 4, 719,778 discloses a device in which the splitter itself is incorporated into the tip of the wedge portion of the ring. US Design Patents 357,051 and 389,628 disclose key shapes having beveled edges which could be used to open a key ring.

German Patent DE 304491 discloses a device in which the head itself can be split open. Of lesser relevance are the devices shown in U.S. Design Patents 367,343 and 485,505. Lastly, U.S. Pat. No. 7,093,468 entitled "Key Ring" describes a device which includes a punched out portion which makes it easier to slide a key into it.

While there are devices described in the prior art to assist in the spreading of key rings, none appears to be as effective, compact and as efficient as the invention set forth herein.

SUMMARY OF THE INVENTION

Briefly described, the invention comprises a tool for assisting in the spreading of a key ring so that a key or similar object can be placed thereon. The invention includes an ascending guide to assist in the spreading of the key ring so that an item can be placed on it and a descending guide in order to assist in the removal of an object from the key ring. In one embodiment the ascending and descending guides are located on opposite sides of a flat tool. According to the preferred embodiment the ascending and descending guides are located on opposite sides of the bridge on the top of the key.

The invention may be more fully understood by reference to the following drawings.

DETAILED DESCRIPTION OF THE INVENTION

During the course of this description like numbers will be used to identify like elements according to the different views that illustrate the invention.

Figure 1:
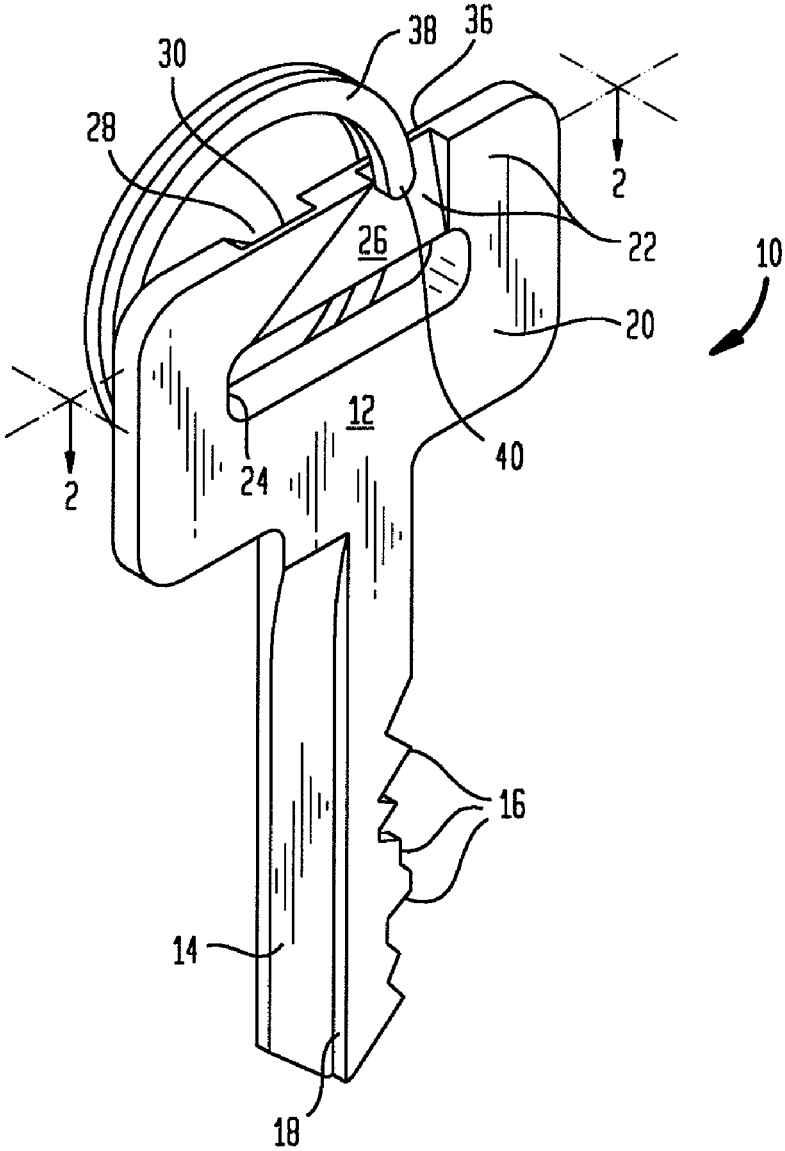
FIG. 1 is a perspective view of an embodiment of the invention as the key ring is just beginning to be spread by the outside edge of the bridge of the key.
Figure 3B:
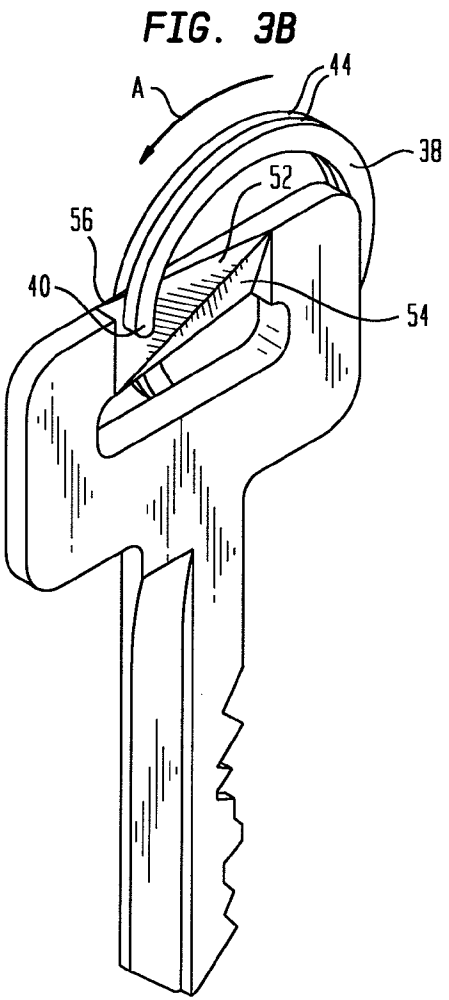
FIG. 3B shows the ring starting to be rotated onto the ramp of the key in a counter clockwise direction.
Figure 3C:
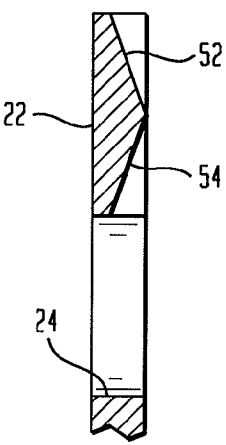
FIG. 3C is a cross-sectional view of the bridge section of the embodiment shown in FIGS. 3A and 3B.
Figure 3A:
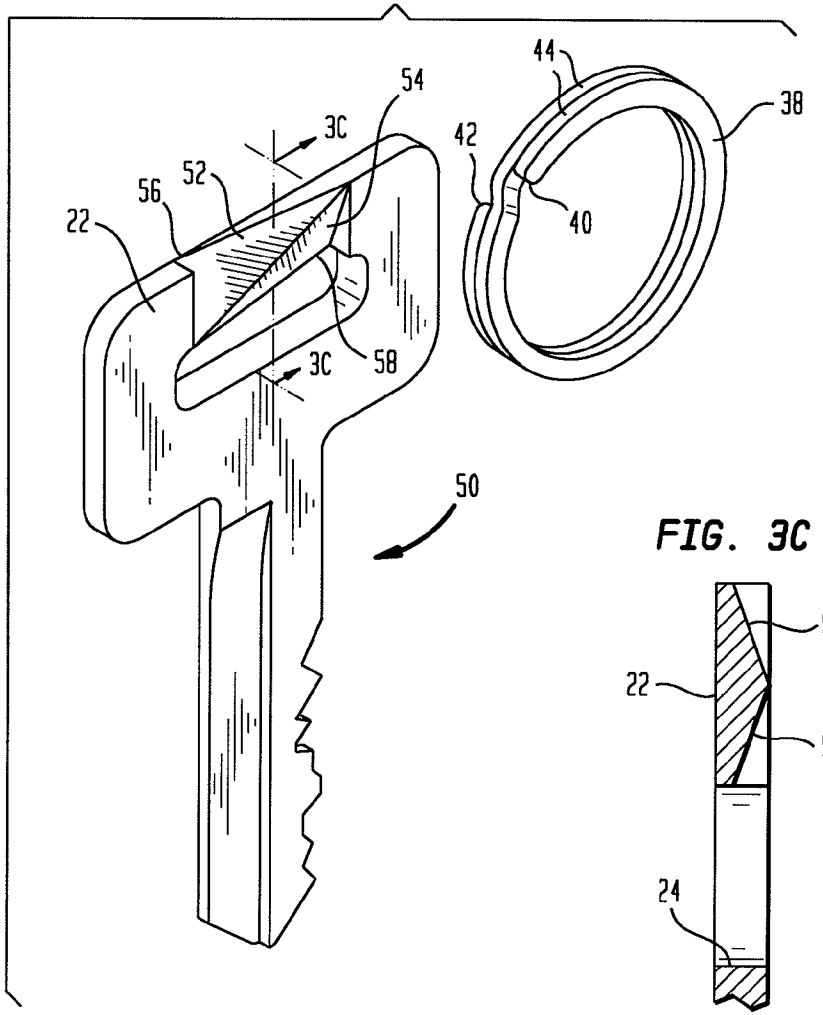
FIG. 3A is a second embodiment of the invention with a key ring not yet introduced.

One embodiment of the invention 10 is illustrated in FIG. 1. As with all keys, embodiment 10 includes key body 12, a key blade 14, and a plurality of teeth 16 on the blade 14. A slot 18 runs along the length of blade 14. A grip section 20, sometimes referred to as the bow, is located at the top of the blade 14. An aperture 24 is located in the grip section 20 and further defines a bridge section 22 on the top of grip section 20. The purpose of the aperture 24 is to accept a key ring 38 such as seen in FIG. 3A. A first and a second wedge shaped section 26 and 28 respectively are located on the bridge 22 of the key 10. Wedge shaped section 26 includes a sharp leading edge 36 whereas the opposite wedge shaped section 28 includes a sharp leading edge 30. The purpose of the wedge shaped sections 26 and 28 is to be able to accommodate the separating of left handed and right handed key rings 38. As seen in further detail in FIG. 3A, a typical key ring 38 has a leading edge 40, a trailing edge 42 and a plurality of coils 44. The key ring 38 shown in FIG. 3A is wound in a clockwise fashion but could also be wound in a counter-clockwise fashion.

Figure 2:
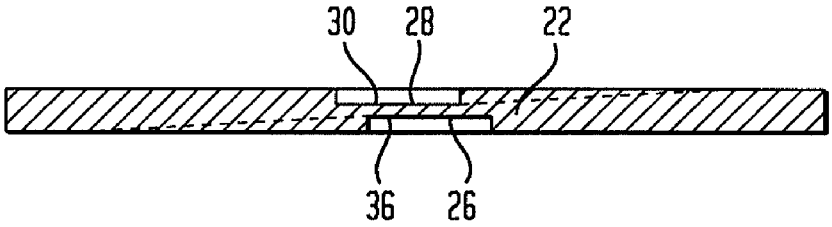
FIG. 2 is a cross-section of the key embodiment shown in FIG. 1

FIG. 2 is a cross-section of the embodiment 10 shown in FIG. 1 seen through perspective 2-2.

If a counter-clockwise key ring 38, especially as shown in FIG. 1 is employed, its leading edge 40 is split from the coils 44 by the sharp leading edge 36 of the wedge shaped ramp section 26. Further rotation of the key ring 38 brings the leading edge 40 into the vicinity of the aperture 24 at which point the key ring is rotated 90° and rotation is continued until the ring is safely captured by the slot 34. On the other hand, if the ring 38 is wound in the opposite direction, then the leading tip 40 would be split by the leading edge 30 of the opposite wedge shaped section 38 and the process repeated until ring 38 is safely encaptured by the aperture 34.

FIG. 3A illustrates an alternative embodiment of the invention 50 which includes a first ramp section 52 on the top of the bridge 22 and a second ramp section 54 on the bottom of the bridge 22. The top ramp section 52 includes a sharp leading edge 56 and the bottom wedge section 54 includes a sharp bottom leading edge 58. A cross-sectional detail of the embodiment 50 as seen from perspective 3C-3C is seen in FIG. 3C.

Figure 3E:
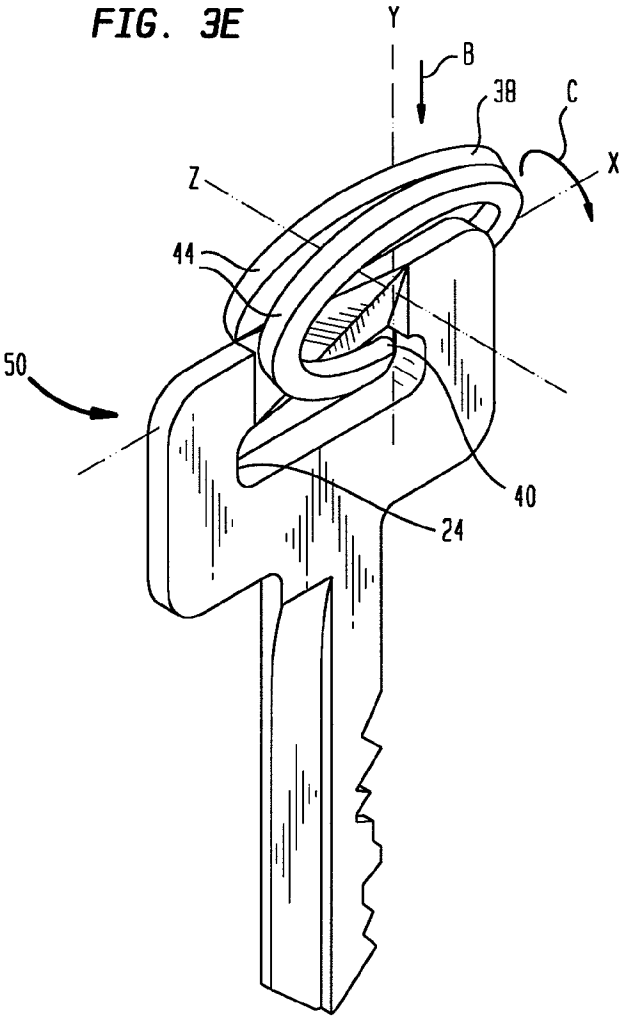
FIG. 3E illustrates the ring being rotated on its X-Axis to allow the leading edge to slip through the slot area of the key and then rotation performed in the Z-Axis in a continuing counter clockwise rotation until the whole ring is within the slot.
Figure 3D:
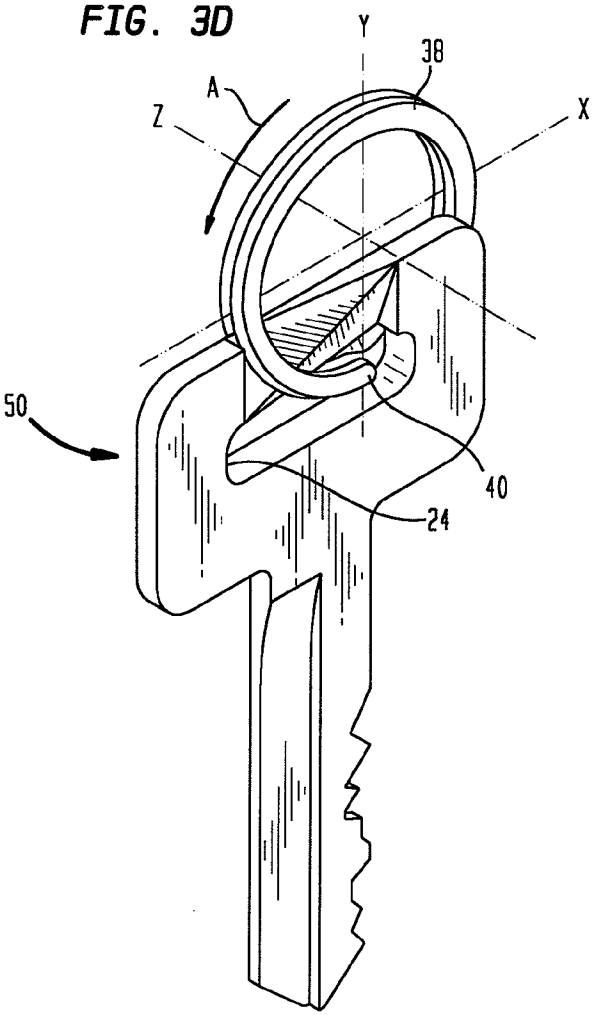
FIG. 3D shows the leading edge of the ring now in the slot area of the key.

FIGS. 3D-3E illustrate the manner in which a ring 38 is attached to the embodiment 50. Initially the leading tip 58 is split from the remaining coils 44 by the sharp leading edge 56 of the upper ramp 52. The key ring 38 is shown rotated in the direction of the arrow A in FIG. 3B to cause the separation of the tip 40 from the rest of the coils 44.

FIG. 3D illustrates the continued rotation of the ring 38 in the direction of the arrow A bringing the tip 40 into the vicinity of the aperture 24. In FIGS. 3C and 3D the ring 38 is rotated in the X-Y plane. When the tip 40 reaches the aperture 24, the key ring 38 is rotated 90° in the direction of arrow C into roughly the X-Z plane by pushing in the direction of arrow B and the tip 40 is fed through the aperture 24 as the key ring 38 continues to rotate. Eventually the entire key ring 38 is captured in aperture 24. When the user chooses to remove the key ring 38, he or she, reverses the process by splitting the trailing edge 42 by means of the lower leading edge 58 of the lower ramp 54 and reversing the process shown in FIGS. 3B-3E until the key ring 38 is eventually released from the embodiment 50. Accordingly, embodiment 50 can be used for both attaching a key ring to a key and for removing a key ring from a key.

The preferred embodiment 60 of the invention is illustrated in FIGS. 4A-4G. Preferred embodiment 60 includes a pair of ramps 62 and 64 on opposite sides of the bridge section 22.

Figure 4B:
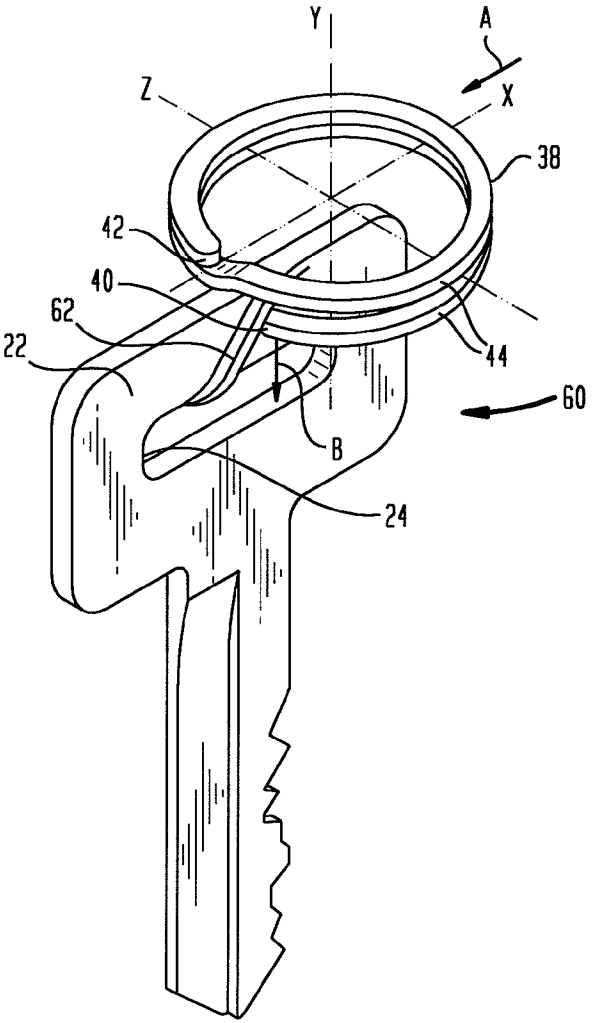
FIG. 4B illustrates the leading edge of the ring as it catches on the relatively sharp protruding ramp on the key forcing it down in a negative Y direction as the key is being pushed into a continuous negative X direction.
Figure 4A:
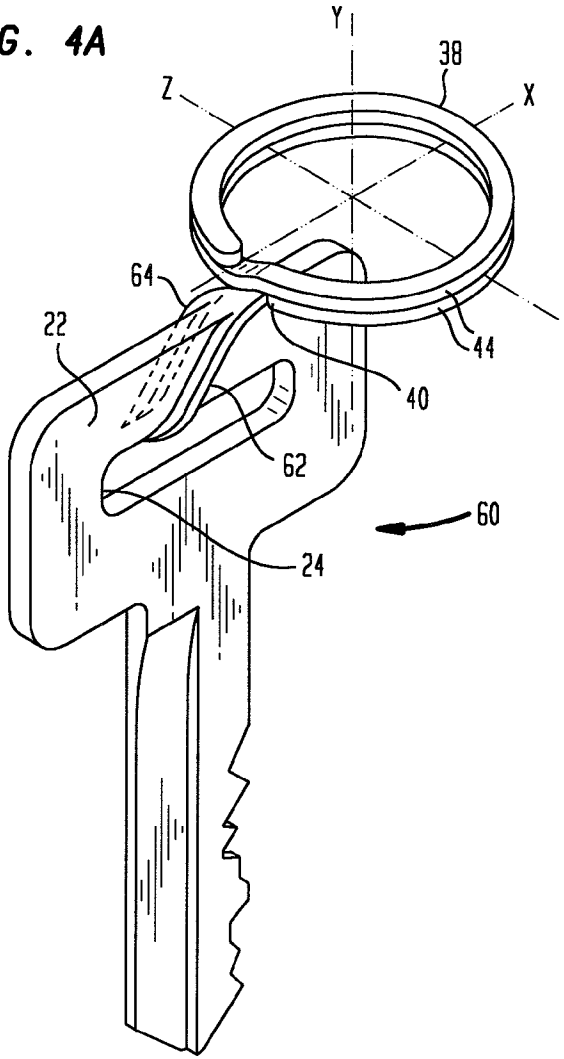
FIG. 4A illustrates the preferred embodiment of the invention showing a ring sliding onto the top of the key in a negative X direction.

The preferred embodiment 60 operates in the following manner. First the leading tip 40 of the key ring 38 engages the sharp leading edge top portion of the rib 62 and is separated from the remaining coils 44 as the key ring 38 is pushed in the X direction as seen in FIG. 4A. As the key ring 38 continues to move in the X direction, as shown by arrow A in FIG. 4B, the tip 40 engages the bottom portion of rib or ramp 62 forcing it downwardly in the direction of arrow B in a negative Y direction as a key continues to be pushed in a negative X direction of arrow A.

Figure 4D:
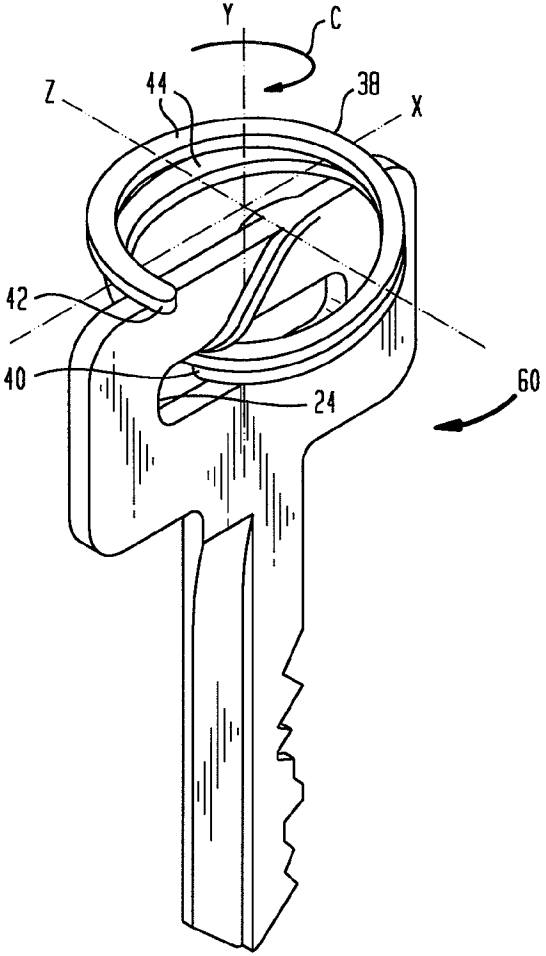
FIG. 4D illustrates the ring as it is about 95% complete in its Y-Axis rotation as it is about to come off the top of the key ring bringing it back together in the form of a complete ring again and the ring being fully inserted into the slot or aperture of the key.
Figure 4C:
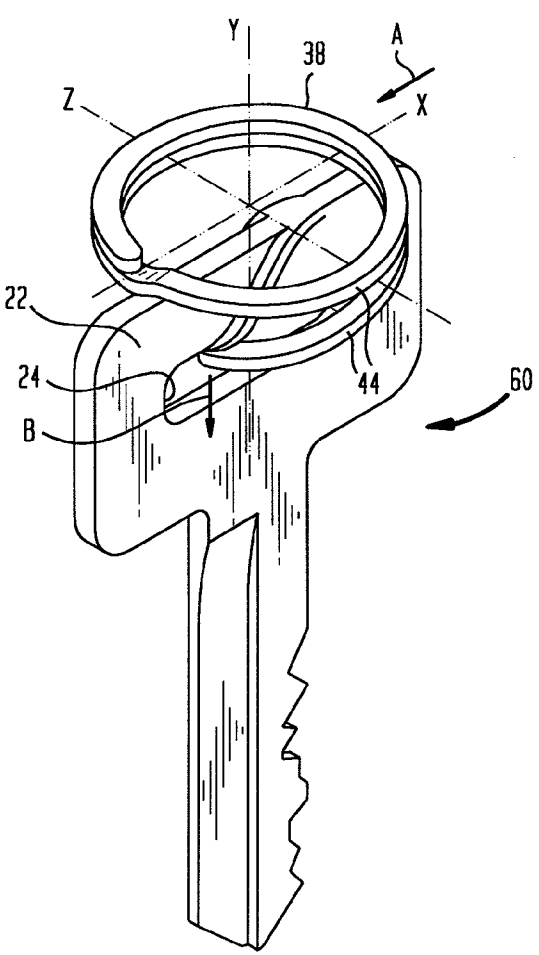
FIG. 4C illustrates the trailing edge of the ring now in the slot area and beginning to be rotated in a clockwise rotation around the Y-Axis.

As the key ring 38 continues to move along the negative X direction, as seen in FIG. 4C, the tip 40 finds itself in the slot area 24 at which point the key ring 38 is rotated clockwise around the Y axis in the direction of arrow C.

FIG. 4D illustrates the key ring 38 when it is approximately 95% complete in its Y axis rotation. In this mode the trailing tip 42 is about to come off the top of the bridge 22 of the key 60 thereby brining it back together in the form of a complete ring with the ring being fully inserted in the slot 24 of the key 60.

Figures 4E, 4F, 4G:
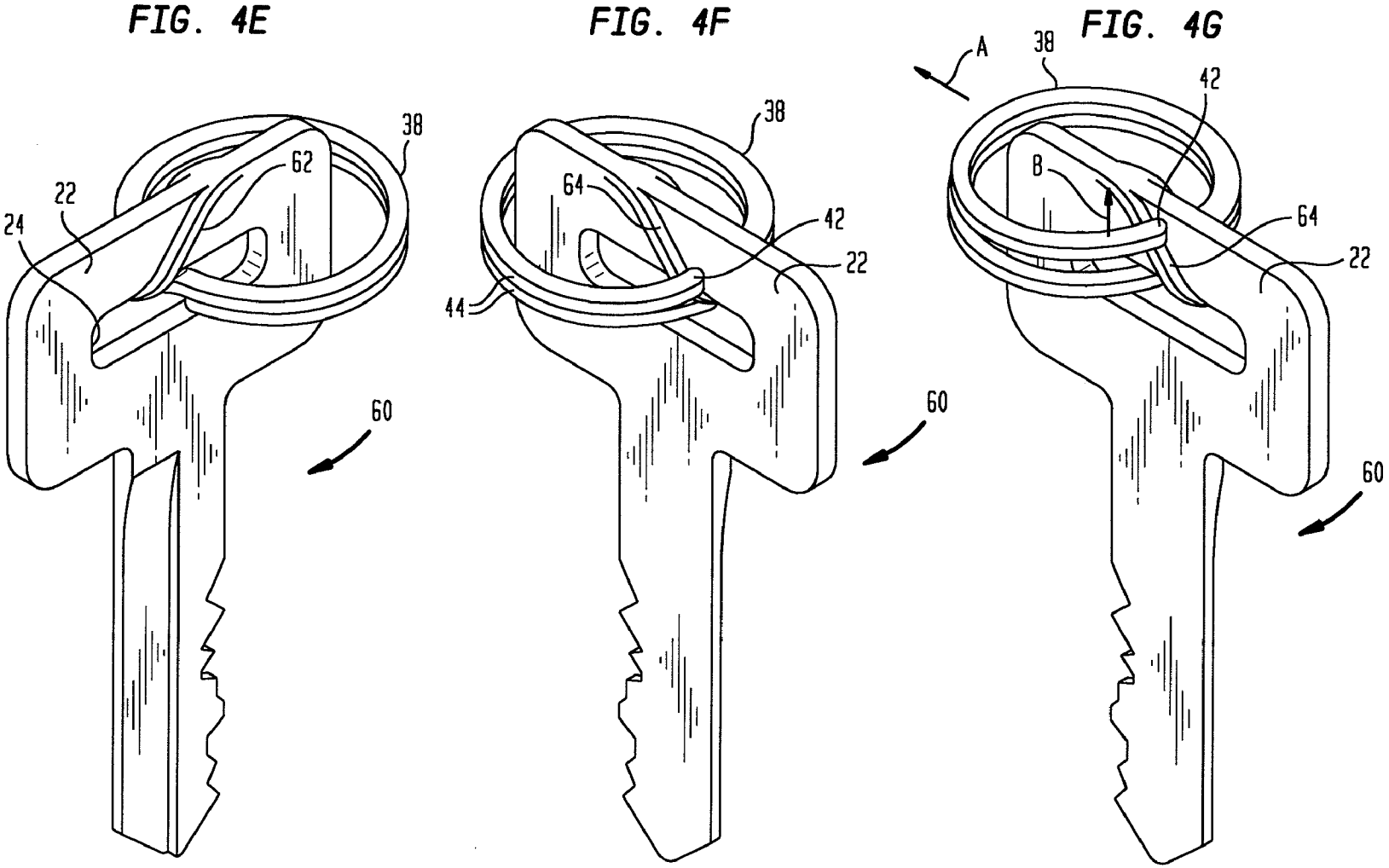
FIG. 4E illustrates the ring now in the slot of the key.
FIG. 4F illustrates the other side of the key as the ring is about to be pulled away from the key ring and the leading edge is now moving up against the ramp as the ring is about to be taken off of the key.
FIG. 4G illustrates the ring being pulled away in the direction of the arrow as the leading edge is being forced up the ramp separating the ring and allowing it eventually to be rotated again in a counter clockwise direction to separate the ring from the key.

FIG. 4E illustrate the key ring 38 now completely received within the slot 24 after the completion of steps 4A-4D.

FIGS. 4F and 4G illustrate the manner in which the key ring 38 can be removed from the preferred embodiment 60.

The first step in the removal mode is to use the bottom of the ramp or rib 64 to initiate the separation of the trailing tip 42 from the other coils 44 of the key ring 38.

Continued pushing of the key ring 38 towards the back of the key 60 in the direction of arrow A shown in FIG. 4G causes the tip 42 to separate in the direction of arrow B and to ride up the ramp 64 until it is at the top of the bridge 22. At that point the key ring 38 is rotated about its own axis until the other tip 40 is clear of the slot 24 and, accordingly, the key ring 38 is free from the preferred embodiment of the key 60.

Figure 4H:
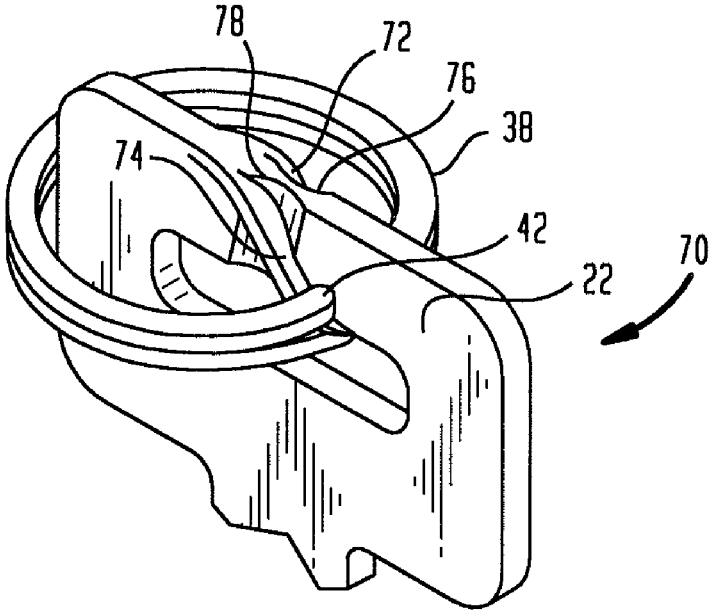
FIGS. 4H and 4I illustrate an alternative embodiment of the invention illustrated in FIGS. 4A-4G, in which there is a vertical groove in the middle of the ascending and descending ribs to assist in the initiation of the key splitting.
Figure 4I:
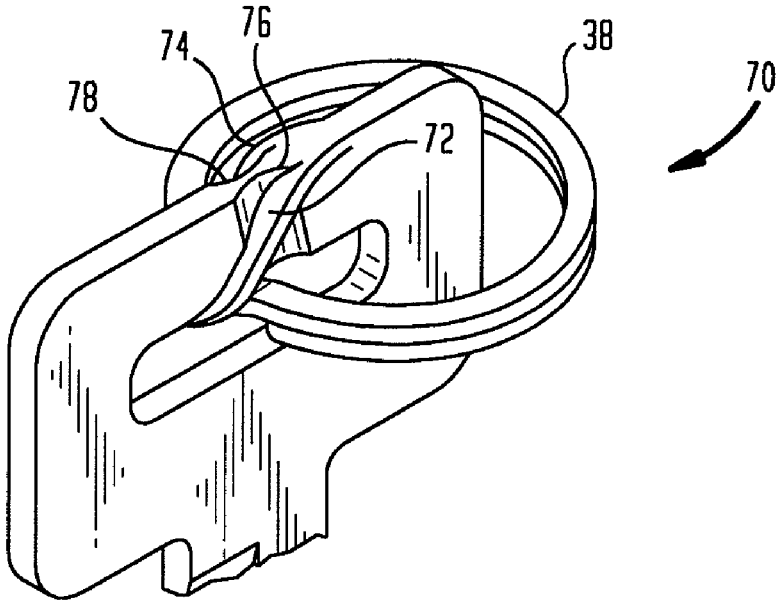

Another embodiment of the invention 70 is illustrated in FIGS. 4H and 4I. Like the preferred embodiment 60, the alternative embodiment 70 includes a pair of ramps or ribs 72 and 74 respectively on opposite sides of the key ring bridge 22. Embodiment 70 includes the additional feature of sculpted indents 76 and 78 respectively on opposite sides of the bridge 22. The purpose of the indents 76 and 78 is to assist in keeping the tips 40 and 42 from slipping off of the ramps 72 and 74 while the key ring 38 is being installed or removed.

Figure 5A:
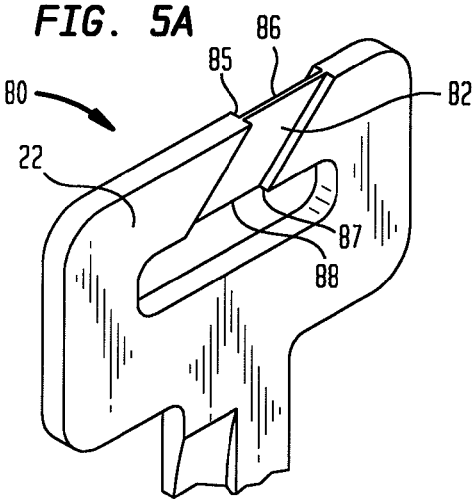
FIG. 5A and 5B illustrate an alternative embodiment of the invention showing a ramp on both sides of the bridge which does not protrude beyond the key's surface.
Figure 5B:
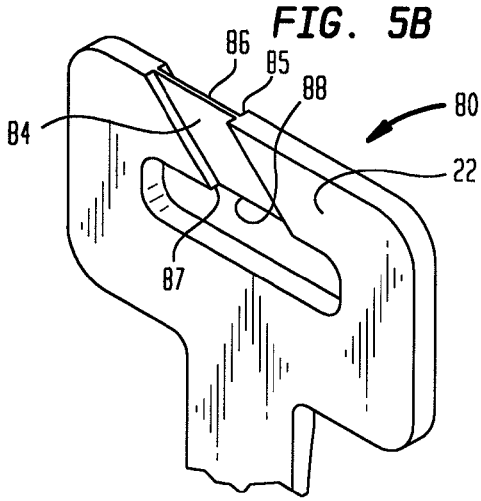

FIGS. 5A and 5B illustrate another alternative embodiment of the invention 80 in which a pair of grooves 82 and 84 are located on either side of the bridge 22. Grooves and 82 and 84 comprise a narrowed section of the bridge 22 and include a tapered top 86 and a tapered bottom 88. This structure creates a pair of sharp leading edges 85 at the junction of tapered top 86 and the top of the bridge 22. Conversely, it also forms a pair of sharp lower leading edges 87 at the juncture of the tapered bottom 88 and the bottom of the bridge 22. The insertion of the key ring 38 starts with the separation of the tip 40 or 42 from the coils 44 by means of the either of the sharp leading edges 85. Continued pushing of the ring 38 causes the tips 40 or 42 to separate further as the tip travels down the edge of the groove 82 or 84 until the loaded tip 40 or 42 enters the aperture 24. The key ring 38 is then rotated like it is with embodiment 60 shown in FIG. 4D until the key ring 38 is fully lodged in the aperture 24 of the key 80. The key ring 38 can be removed by separating the tip 40 or 42 from the coils 38 using either of the bottom sharp leading edges 87 and then continuously pushing the ring 38 up the edge of the groove 82 or 84 until the tip 40 or 42 reaches the top of the bridge 22. Once that happens the key ring 38 is rotated until it is free of the bridge 22.

Figure 6A:
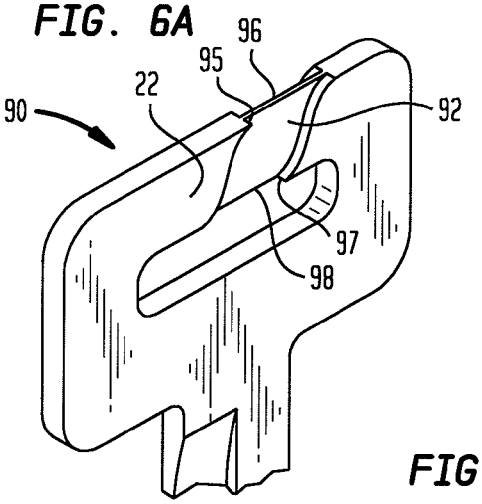
FIGS. 6A and 6B illustrate another alternative embodiment of the invention with a concave or groove ramp inserted into opposite sides of the bridge so that it does not protrude beyond the key's normal surface, except that the ramps have a generally "S" shape.
Figure 6B:
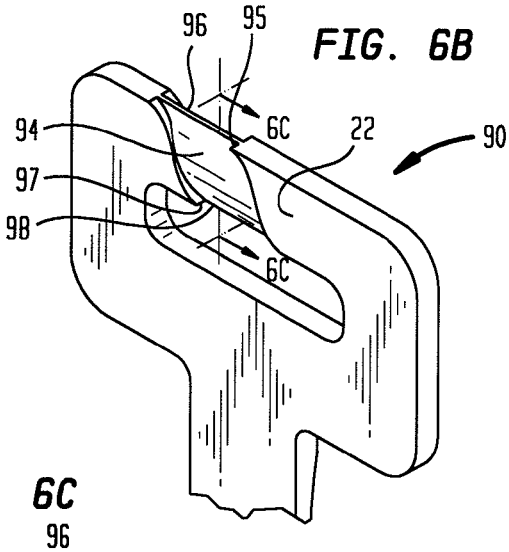
Figure 6C:
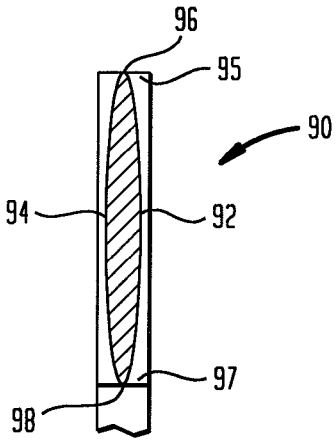
FIG. 6C is a cross-sectional view of the ramp illustrated in the embodiment of 6A and 6B showing that the cross section of the ramp has a generally oval shape with sharp edges at either end and significant thickness in the center.
Figure 7A:
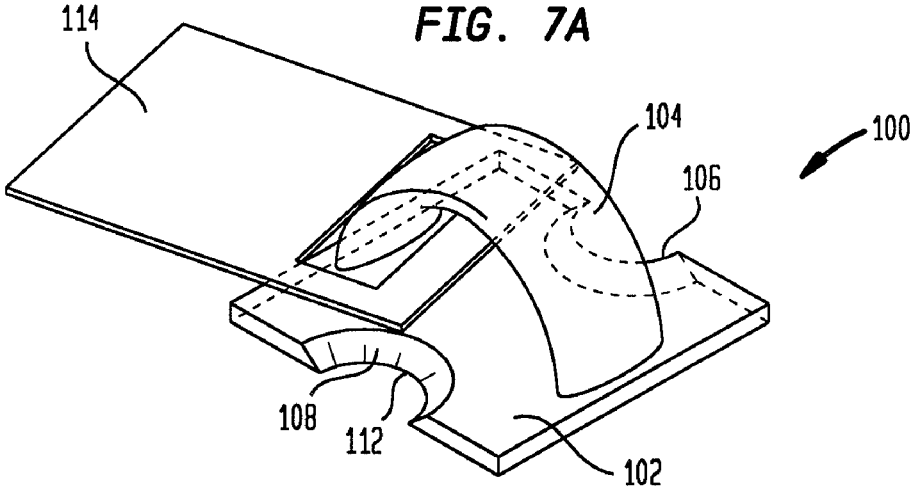
FIGS. 7A-7E illustrates different views of an embodiment of the invention in which the tool is separate from the key itself.
Figure 7B:
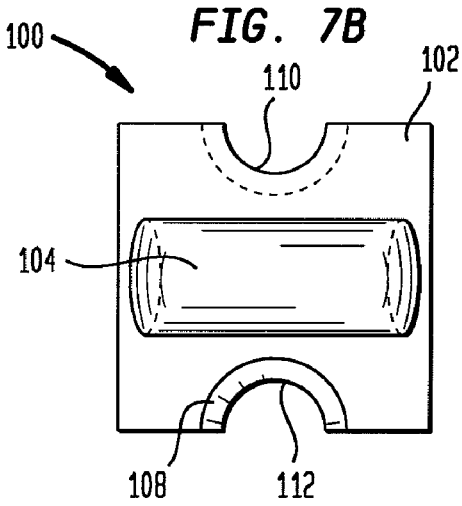
Figure 7C:
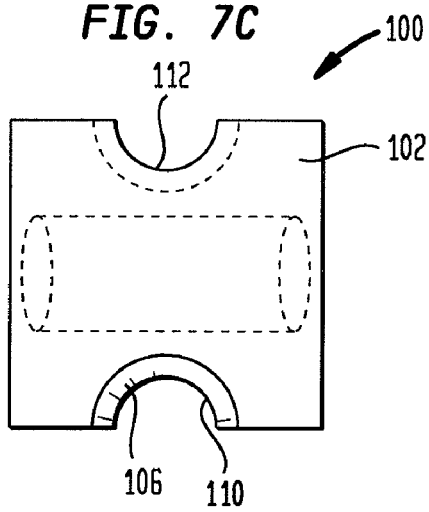
Figure 7D:
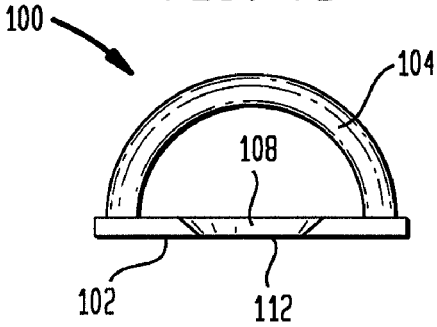
Figure 7E:
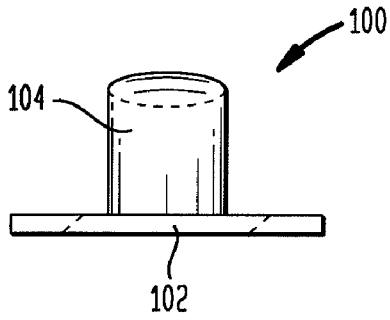

Another alternative embodiment of the invention 90 includes a pair of groove sections 92 and 94 which have an "S" shape side elevational profile. Like embodiment 80, the grooves 92 and 94 lie totally within the plane of the bridge section 22 of the embodiment 90. Also like embodiment 80, the groove sections 92 and 94 have a tapered top 96 and a tapered bottom 98. A cross-sectional profile of the grooves 92 and 94 is seen in FIG. 6C from perspective 6C-6C of FIG. 6B. This structure creates a pair of sharp leading edges 95 at the junction of tapered top 96 and the top of the bridge 22. Conversely, it also forms a pair of sharp lower leading edges 97 at the juncture of the tapered bottom 98 and the bottom of the bridge 22 as seen in FIGS. 6A-6C. The process of attaching or removing a key ring 38 from embodiment 90 is essentially identical to that explained above with respect to embodiment 80.

It should be noted that embodiment 90 is essentially a mirror image of embodiment 60 except that grooves 94 and 96 are substituted for exterior ribs 62 and 64. Embodiments 80 and 90 are especially suited for the case where the handle or grip 20 of the key is relatively thick. The substitution of a concave groove structure resembles the general shape of the rib embodiments FIGS. 7A-7E illustrates a tool embodiment of the invention which may or may not be incorporated into a key. The tool 100 includes a base 102 and a semi-circular ring or handle section 104 which is attached to the base 102 at two places. A pair of semi-circular cut-out sections 106 and 108 are located on opposite edges of plate 102. The first semi-circular cut-out 106 has edges that bevel from the bottom of the plate 102 towards the top culminating in a sharp leading edge 106. The second semi-circular cut-out 108 tapers, or bevels, downward from the top of the plate 102 culminating in a sharp leading edge 112 on the bottom of the plate. Note that cut-out sections 106 and 108 face in opposite directions, that is to say the sharp leading edge 110 of the first cut-out section 106 is located on the top of the plate 102 whereas the sharp leading edge 112 of the second cut-out section 108 is located on the bottom of the plate 102. A tag 114 or key or other similar object or objects can be attached to the ring 104. The tag 114 could, for example, comprise an electronic wireless car key.

The manner in which the tool 100 is used to open a key ring 38 is illustrated in FIGS. 8A-8D.

Figure 8A:
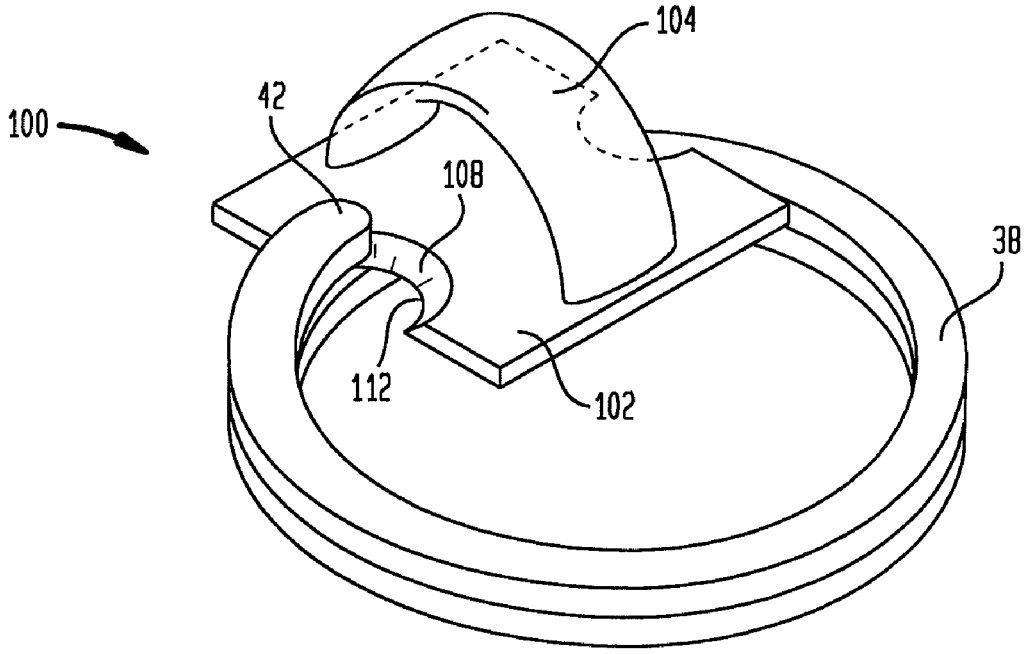
FIGS. 8A-8D illustrates the manner in which the tool illustrated in FIGS. 7A though 7E is used to separate the coils of a key ring so that a key or other object can be placed thereon.

The first step in the process is to split the tip 42 from the rest of the key ring coils 44 by using the sharp edge 112 of the cut-out 108 as shown in FIG. 8A.

Figure 8B:
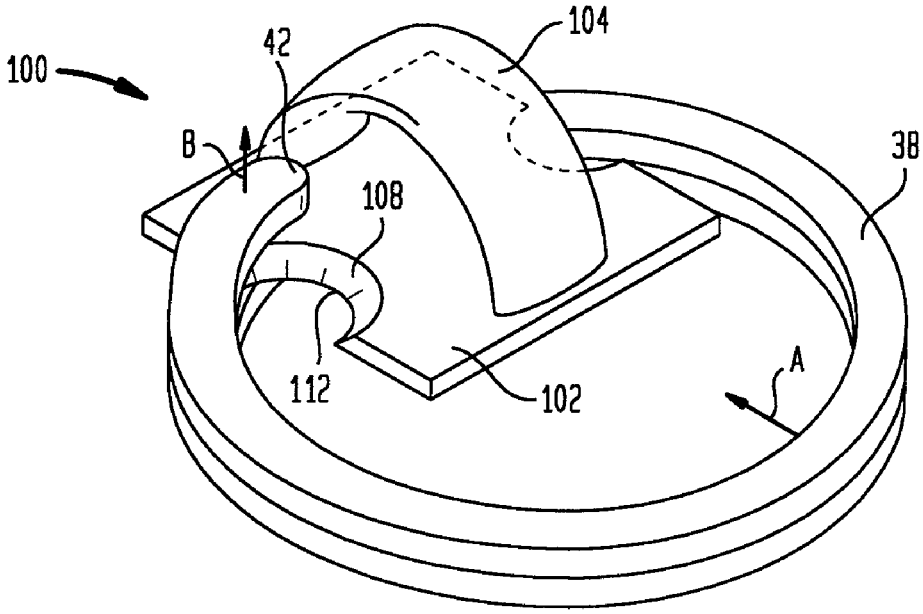

According to the second step as show in FIG. 8B, the key ring 38 is pushed in the direction of arrow A in a plane roughly parallel to the plane of plate 102. This forces the tip 42 upward in the direction shown by the other arrow B in FIG. 8B and onto the top surface of the plate 102.

Figure 8C:
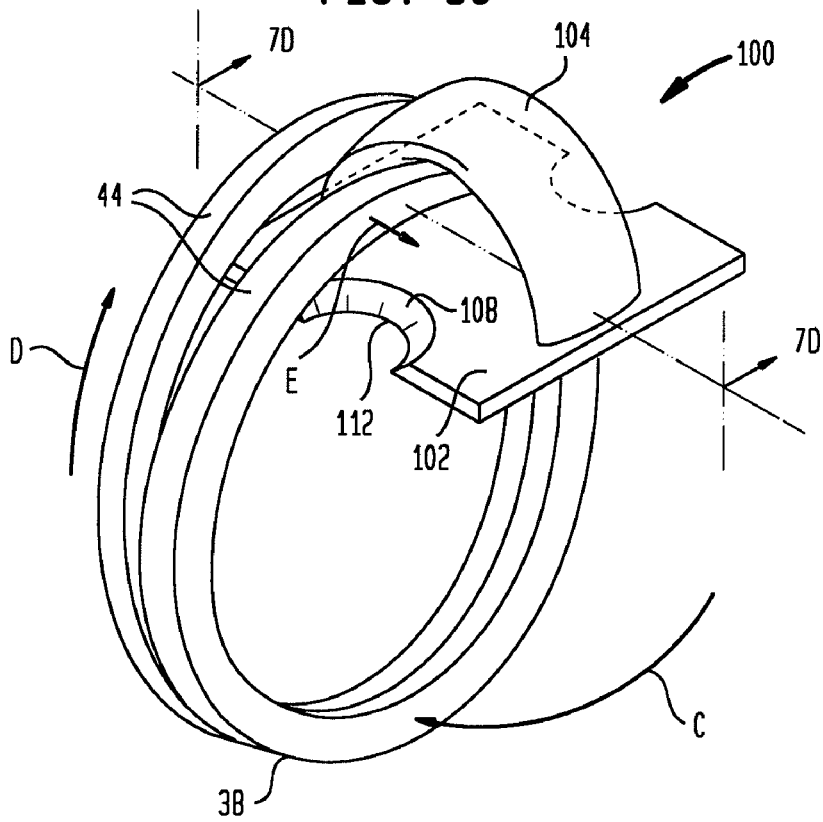

The third step on the process is seen in FIG. 8C. The key ring 38 is rotated 90 degrees downward in the direction of arrow C so that the plane of the ring 38 is perpendicular to the plane of the plate 102. In that position it is possible to rotate the ring clockwise in the direction of arrow D so that the tip 42 straddles the handle 104 causing it to separate further from the remaining coils 44 in the direction of arrow E.

Figure 8D:
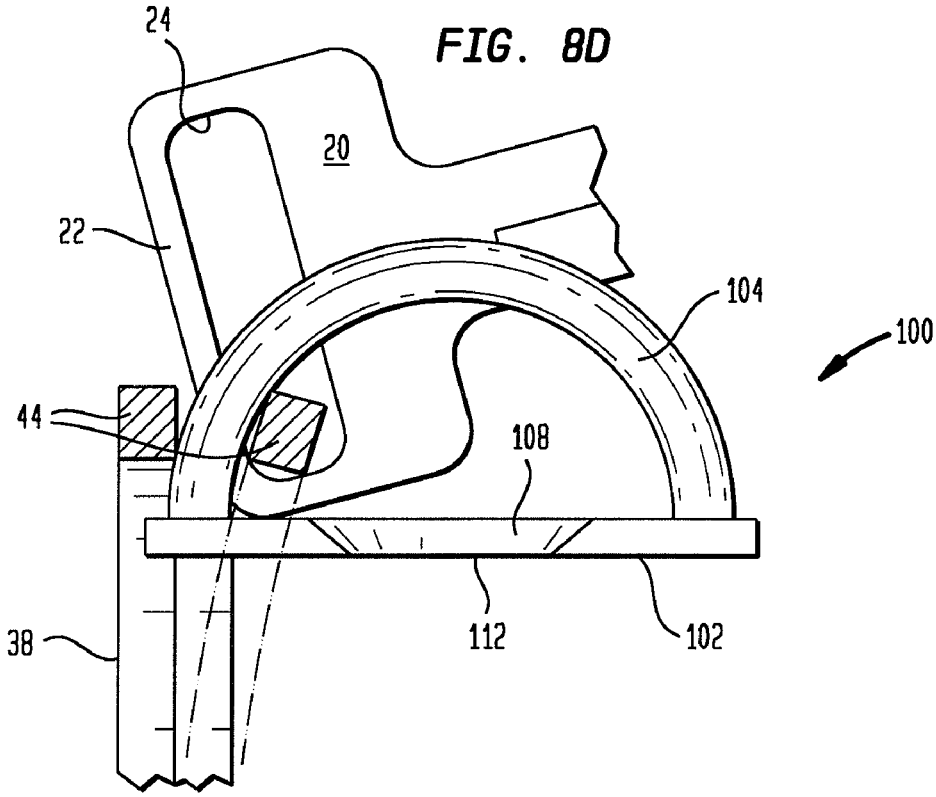

The fourth and last step, as shown in FIG. 8D, is to place the tip 42 of the key ring 38 through the aperture 24 in the grip section 22 of the key and continue rotation in the direction of arrow D until the trailing tip 40 passes through the handle 104 and aperture 24. After steps 8A-8D are complete the key, key ring 38 and tool 100 are all connected together. The process can be reversed by using the other sharp leading edge 110 of cut-out 106 to initiate separation of either tip 40 or 42 from the coils 44 and then proceeding in a fashion shown in FIGS. 8D to 8A when the ring 38 and the key are then totally disengaged from the tool 100.

The invention described above is preferably made from a hardened metal but other hard plastics or ceramics or any other materials that hold its form and an edge would be suitable. The tool concept can be incorporated into the bridge of the key or can be a separate tool.

While the invention has been described with reference to a preferred embodiment thereof it will be appreciated by those of ordinary skill in the art that various changes can be made to the structure and materials of the invention without departing from the spirit and scope of the invention as a whole.

The invention claimed is:

1. A key apparatus for attachment to a key ring of the type including a resilient, elongated material having a first and a second end and coiled into one or more loops, said key ring apparatus comprising:

a key body having a blade, a grip, a bridge section on top of said grip section and an aperture for engaging said key ring; and first and second ribs located on opposite sides of said bridge and extending substantially from said aperture to the top of said key, for spreading the loops of said key ring so that it can be accepted in said aperture in said grip section, said first and second ribs including first relatively sharp leading edges, wherein said first relatively sharp leading edges initiates the opening of said key ring loops which progressively spread wider as the loops progress along said first or second ribs until the key ring is spread sufficiently such that one end of said key ring can pass through the aperture in said grip; and wherein said first and second ribs define second relatively sharp leading edges opposite said first relatively sharp leading edges, said second relatively sharp leading edges initiating the opening of said key ring loops which progressively spread wider as the loops progress along said first or second ribs until the key ring is spread sufficiently such said key ring can be removed from said aperture in said grip.

2. The key apparatus of claim 1 wherein said first and second ribs have a generally "S" shaped profile.

3. The key apparatus of claim 1 wherein said ribs lie in a plane outside of the plane of said grip.

4. The key apparatus of claim 1 further comprising a first and a second cut-out section located between said first and second ribs respectively and said grip.

5. A key apparatus comprising:

a key body having a blade, a grip, a bridge section on top of said grip section and an aperture for engaging said key ring; and first and second ribs located on opposite sides of said bridge extending substantially from said aperture to the top of said bridge, said first and second ribs including first relatively sharp leading edges on one end thereof and second relatively sharp leading edges located on the opposite end thereof;

wherein the profile of said first and second ribs is selected from a group consisting of straight and S-shaped.

6. A key apparatus comprising:

a key body having a blade, a grip, a bridge section having a top side and a bottom side located on the top of said grip section, and an aperture for engaging said key ring;

first and second grooves located on opposite sides of said bridge section, said first and second grooves sharing a common wall, said first and second grooves each having one side which defines a relatively sharp top leading edge adjacent the top of said bridge section and a relatively sharp bottom leading edge adjacent the bottom of said bridge section;

wherein the profile of the side of each of said grooves defining said relatively sharp top and bottom leading edges is selected from a group consisting of straight and S-shaped.

7. The key apparatus of claim 6 wherein said top and bottom leading edges initiate the spreading of one end of a key ring from said loops and continues the spreading wider as the end progress along the edge of said first or second groove until the key ring is spread sufficiently such that one end of the key ring can pass through the aperture in said grip to facilitate the insertion or removal of said key ring from said aperture.

* * * * *